US009876295B2

(12) United States Patent
Hori

(10) Patent No.: US 9,876,295 B2
(45) Date of Patent: Jan. 23, 2018

(54) ELECTRIC CONNECTOR

(71) Applicant: IRISO ELECTRONICS CO., LTD., Yokohama, Kanagawa (JP)

(72) Inventor: Kiichi Hori, Kanagawa (JP)

( * ) Notice: Subject to any disclaimer, the term of this patent is extended or adjusted under 35 U.S.C. 154(b) by 0 days.

(21) Appl. No.: 15/366,459

(22) Filed: Dec. 1, 2016

(65) Prior Publication Data

US 2017/0179626 A1 Jun. 22, 2017

(30) Foreign Application Priority Data

Dec. 22, 2015 (JP) ..... 2015-250699

(51) Int. Cl.

| | |
|---|---|
| ***H01R 29/00*** | (2006.01) |
| ***H01R 12/71*** | (2011.01) |
| ***H01R 13/11*** | (2006.01) |
| ***H01R 13/44*** | (2006.01) |

(52) U.S. Cl.

CPC ..... *H01R 12/712* (2013.01); *H01R 13/11* (2013.01); *H01R 13/44* (2013.01)

(58) Field of Classification Search

CPC .. H01R 2100/00; H01R 29/00; H01R 13/465; H01R 13/641; H01R 31/08; H01R 13/432; H01R 24/58

USPC ..... 439/188, 189, 488, 489, 513, 746, 747; 200/51.1

See application file for complete search history.

(56) References Cited

U.S. PATENT DOCUMENTS 4,106,841 A 8/1978 Vladic
4,850,888 A * 7/1989 Denlinger ..... H01R 13/7032 439/188
5,378,164 A * 1/1995 Vidacovich ..... H01R 12/82 200/51.1
5,466,168 A * 11/1995 Liebich ..... H01R 13/7032 439/188
5,470,243 A * 11/1995 Bendorf ..... H01R 13/7032 439/188
5,533,907 A * 7/1996 Kozel ..... H01R 12/721 200/51.1
5,693,924 A * 12/1997 Fetterolf, Sr. ..... H01R 24/46 200/51 R
5,944,547 A * 8/1999 Golab ..... H01R 13/7032 200/51.1

(Continued)

FOREIGN PATENT DOCUMENTS

JP 53-133790 A 11/1978

*Primary Examiner* — Thanh Tam Le

(74) *Attorney, Agent, or Firm* — Cermak Nakajima & McGowan LLP; Tomoko Nakajima

(57) ABSTRACT

A socket connector includes a first connection terminal and a second connection terminal that come into electrical contact with a plug connector, and a socket housing having an insertion opening for the plug connector. The first connection terminal is provided with a switch contact piece and a terminal body that comes into electrical contact with the plug connector. The switch contact piece has an opening contact point portion that comes into pressure contact with the plug connector, a short-circuit contact point portion, and an elastic arm that elastically supports the opening contact point portion and the short-circuit contact point portion and that is elastically deformed when the opening contact point portion is pressed by the plug connector, and thereby brings the short-circuit contact point portion out of contact with the second connection terminal.

4 Claims, 17 Drawing Sheets

(56) References Cited

U.S. PATENT DOCUMENTS

| | | | | |
|---|---|---|---|---|
| 6,036,515 | A * | 3/2000 | Nakamura | H01R 13/7032 439/188 |
| 6,186,805 | B1 * | 2/2001 | Krishnaswamy | H01R 13/7032 200/51.1 |
| 6,575,775 | B2 * | 6/2003 | Hasegawa | H01R 13/41 439/188 |
| 6,942,510 | B2 * | 9/2005 | Nakamura | H01R 13/7033 439/188 |
| 7,402,057 | B1 * | 7/2008 | Strang | H01R 13/7032 439/188 |
| 7,955,104 | B1 * | 6/2011 | Wicks | H01R 13/7032 439/188 |

* cited by examiner

ELECTRIC CONNECTOR

BACKGROUND OF THE INVENTION

1. Field of the Invention

The present invention relates to a connector that forms different circuits in a fitted state of a connection object and an unfitted state.

2. Description of the Related Art

There is a case where a connection object such as an expansion board is connected to a connector fixed to a circuit board to expand the function of an electrical device. Such a connector can also be used in an unfitted state of the connection object. There is a case where the connection object in a fitted state is extracted and another connection object is fitted. This connector has a plurality of terminals disposed opposite each other. In an unfitted state where the connection object is not connected to the connector, the terminals come into electrical contact with each other to form a short-circuited closed circuit. When fitting the connection object, the closed circuit is opened, and comes into electrical contact with terminals to form another circuit, and a new function can thereby be added (for example, Japanese Unexamined Patent Application Publication No. 53-133790).

In the above-described connector, a pressed portion for opening a closed circuit that is pressed and displaced by a connection object, and a contact point portion for connection to the connection object are provided in the same elastic piece. During the fitting of the connection object, the contact point portion for connection is displaced in conjunction with the pressed portion for opening. Therefore, if the connection object is repeatedly inserted and extracted, the terminal is plastically deformed, and the contact point portion for connection may become difficult to bring into electrical contact with the connection object. This contact point portion for connection also serves as a contact point portion when the terminals come into electrical contact with each other in the unfitted state. Therefore, there is a likelihood that the terminals are plastically deformed away from each other, and it thereby becomes impossible to bring the contact point portions for connection into contact with each other and to form the above closed circuit in the unfitted state of the connection object.

The present invention has been made to solve the above problem. That is, it is an object of the present invention to provide a connector that can reliably perform short-circuit connection of terminals in an unfitted state, and electrical connection with the connection object in a fitted state even after a connection object is repeatedly inserted and extracted.

SUMMARY OF THE INVENTION

To attain the above object, the present invention is configured as follows.

In an aspect of the present invention, a connector includes a first connection terminal and a second connection terminal that come into electrical contact with a connection object, and a housing having an insertion opening for the connection object. The first connection terminal has a switch contact piece and a terminal body that comes into electrical contact with the connection object. The switch contact piece has an opening contact point portion that comes into pressure contact with the connection object inserted into the housing, a short-circuit contact point portion that comes into electrical contact with the second connection terminal, and an elastic arm that elastically supports the opening contact point portion and the short-circuit contact point portion and that is elastically deformed when the opening contact point portion is pressed by the connection object, and thereby brings the short-circuit contact point portion out of contact with the second connection terminal.

The connector of the present invention has a first connection terminal having a switch contact piece having an opening contact point portion and a short-circuit contact point portion, and a terminal body that comes into electrical contact with a connection object. Therefore, if owing to insertion and extraction of the connection object, the terminal body is repeatedly elastically deformed away from the connection object, the short circuit connection by the switch contact piece is not influenced. In addition, if the switch contact piece is repeatedly elastically deformed away from the connection object, the electrical contact between the terminal body and the connection object is not influenced.

The connector may further include a signal terminal having a contact point portion with the connection object, and the opening contact point portion may be disposed nearer to the insertion opening than the contact point portion in the insertion and extraction direction of the connection object.

In this case, during the insertion of the connection object into the connector of the present invention, first, the connection object comes into contact with the opening contact point portion and brings the short-circuit contact point portion out of contact with the second connection terminal, and then the connection object comes into electrical contact with the signal terminal. Therefore, the connection object can be brought into electrical contact with the signal terminal after the closed circuit is reliably opened.

The switch contact piece may have the opening contact point portion on the distal end side of the short-circuit contact point portion, and may have the elastic arm on the proximal end side of the short-circuit contact point portion.

By doing so, if the opening contact point portion disposed on the distal end side of the switch contact piece is pressed with a small force, the elastic arm provided on the proximal end side of the switch contact piece can be easily elastically deformed by using the principle of leverage. Therefore, the short-circuit contact point portion can be brought out of contact with the second connection terminal with a small force.

The opening contact point portion and the short-circuit contact point portion may be disposed at different positions in a direction intersecting the insertion and extraction direction of the connection object.

By doing so, the connection object comes into contact only with the opening contact point portion and does not come into contact with the short-circuit contact point portion. Therefore, deformation or the like of the short-circuit contact point portion due to the contact of the connection object with the short-circuit contact point portion can be prevented.

The short-circuit contact point portion and the second connection terminal may be in electrical contact with each other in an accommodating portion provided in the housing.

By doing so, a decrease in connection reliability due to the contact of another member with the contact part between the short-circuit contact point portion and the second connection terminal can be prevented.

Since the connector of the present invention has a terminal body and a switch contact piece, the formation and opening of a closed circuit can be switched without interfering with each other. Therefore, the short-circuit connection in the unfitted state can be reliably performed even after the connection object is repeatedly inserted and extracted, and therefore malfunction of the electrical device can be prevented. During the fitting, by ensuring the electrical connection and opening the short-circuit connection, signal connection can be reliably performed.

DESCRIPTION OF THE PREFERRED EMBODIMENTS

Figure 1:
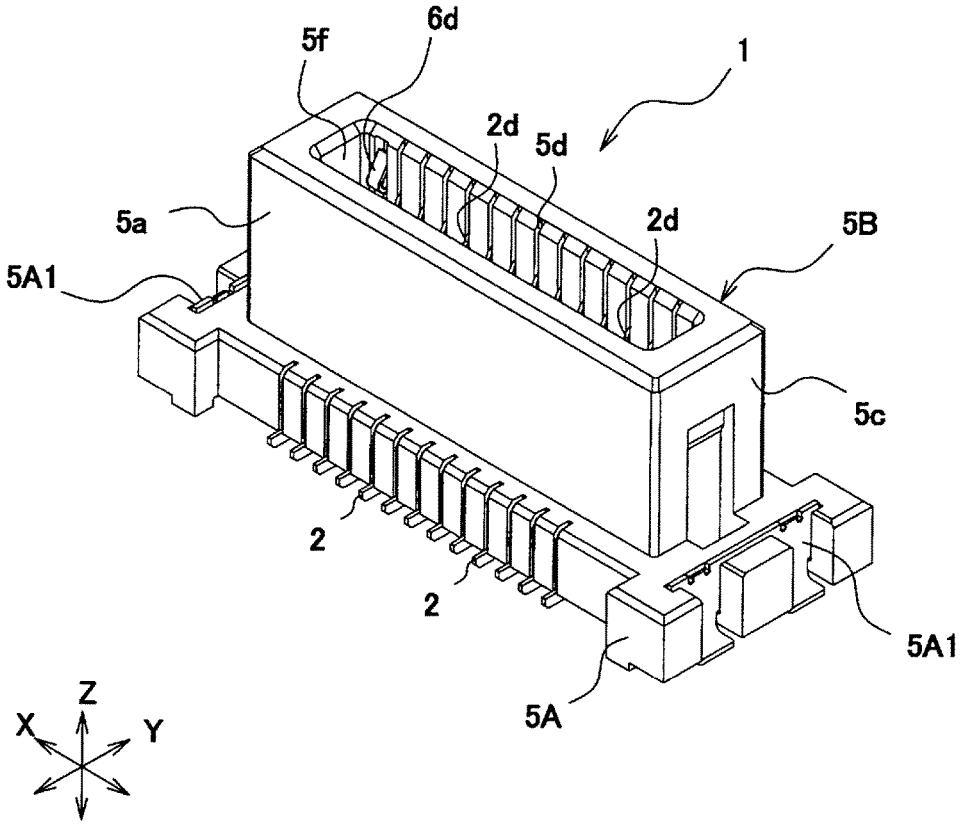
FIG. 1 is a perspective view showing a socket connector of an embodiment.
Figure 2:
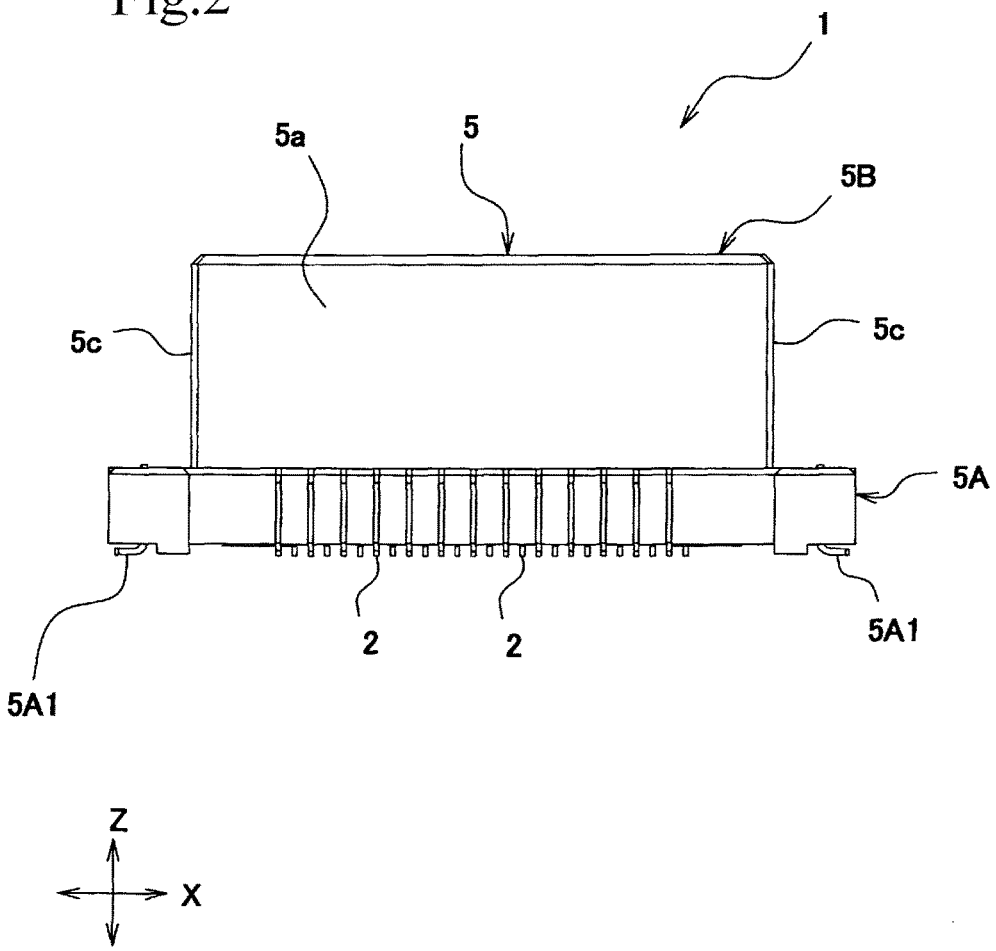
FIG. 2 is a front view showing the socket connector of FIG. 1.
Figure 3:
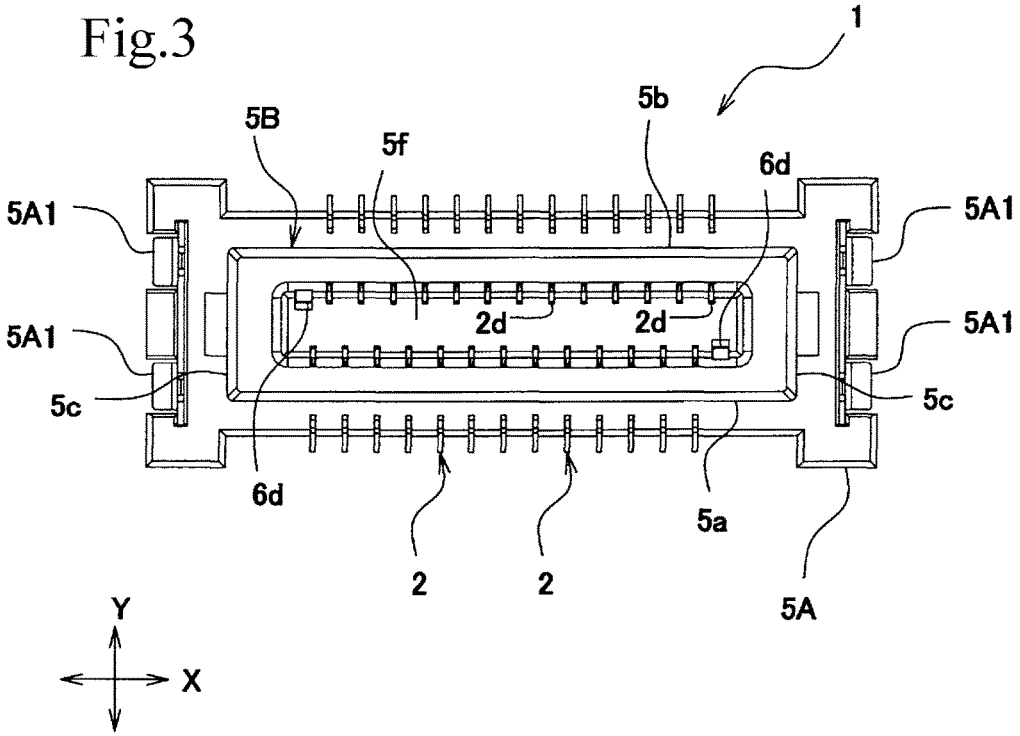
FIG. 3 is a plan view showing the socket connector of FIG. 1.
Figure 4:
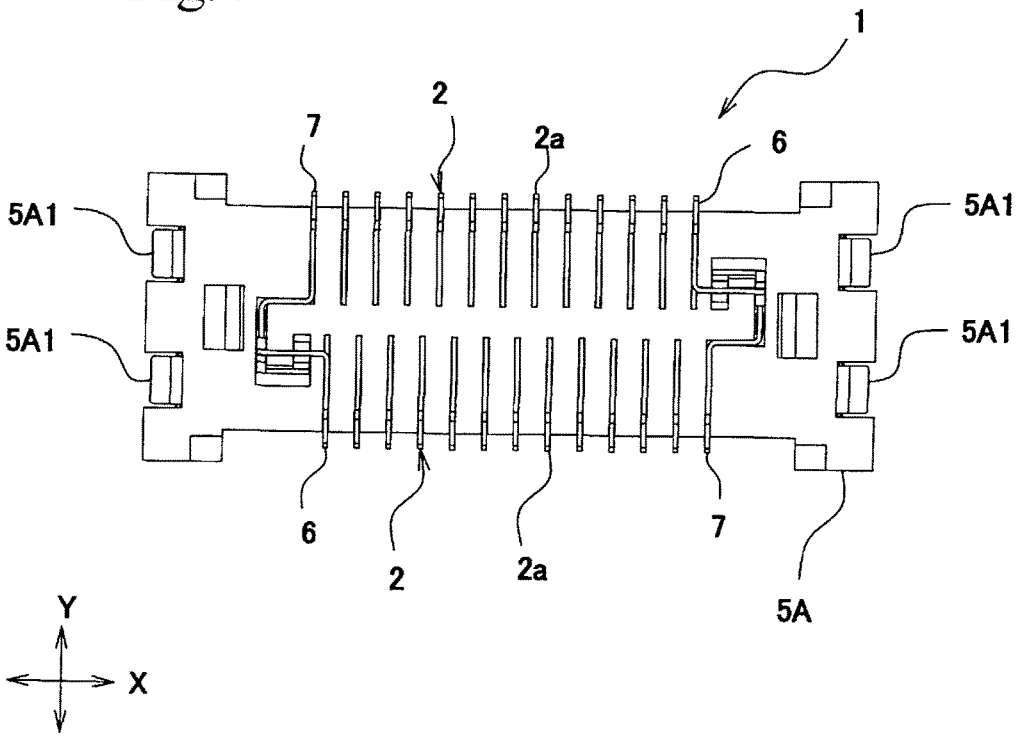
FIG. 4 is a bottom view showing the socket connector of FIG. 1.
Figure 5:
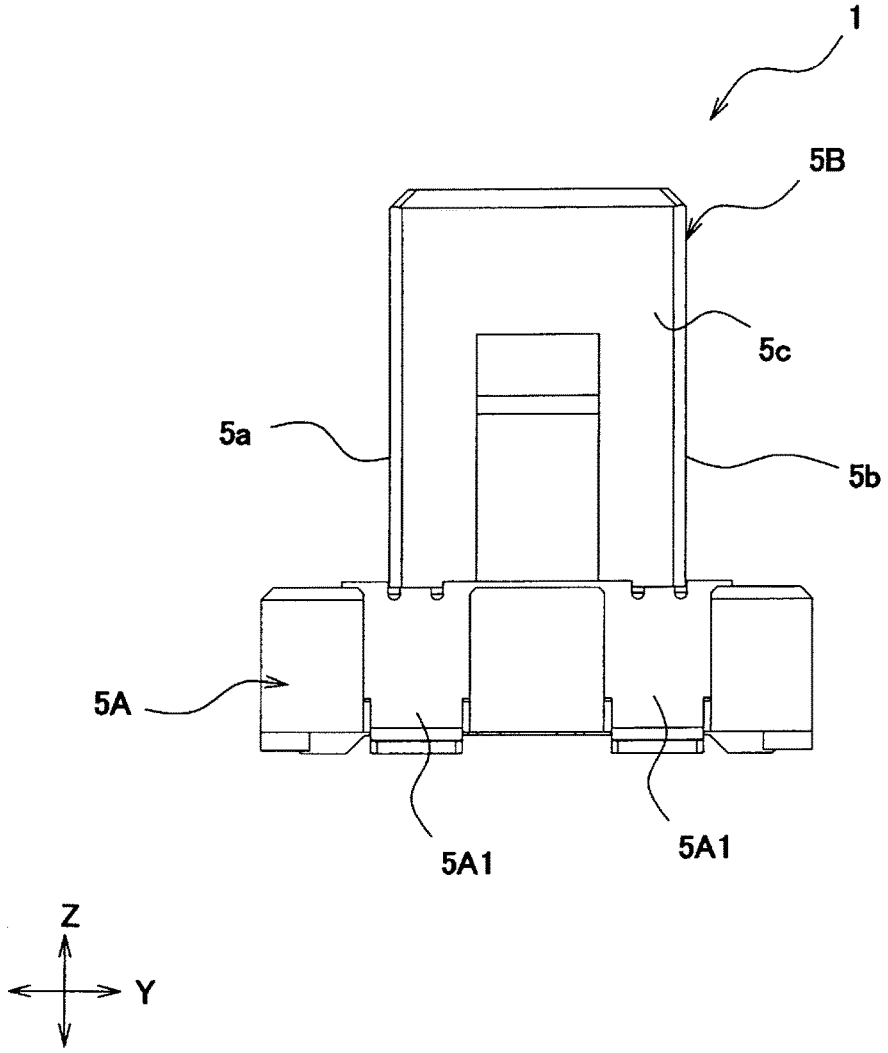
FIG. 5 is a right side view showing the socket connector of FIG. 1.

A preferred embodiment of a connector of the present invention will be described below with reference to the drawings. In this embodiment, a socket connector 1 attached to an electrical device (not shown) is shown as a "connector." The socket connector 1 has socket terminals 2 that are soldered to a circuit board P1. A plug connector 3 including plug terminals 4 that are soldered to a circuit board P2 is shown as a "connection object." The plug connector 3 is used to expand the functions of the electrical device to which the socket connector 1 is attached. By fitting together the socket connector 1 and the plug connector 3, the socket terminals 2 come into electrical contact with the plug terminals 4, and the circuit board P1 is electrically connected to the circuit board P2.

In this specification, the width direction (longitudinal direction) of the socket connector 1 is referred to as X direction, the front-back direction (short side direction) is referred to as Y direction, and the height direction (vertical direction) is referred to as Z direction. The side of the socket connector 1 in the height direction Z is referred to as "lower side," and the plug connector 3 side is referred to as "upper side." However, these do not limit the manner in which the socket connector 1 and the plug connector 3 are mounted and used. Because the left side view of the socket connector 1 is symmetrical to the right side view, the depiction thereof is omitted.

Embodiment (FIGS. 1 to 18)

Socket Connector

As shown in FIGS. 1 to 4, the socket connector 1 includes a socket housing 5, a plurality of socket terminals 2, and short-circuit connection structures 1*a*. The short-circuit connection structures 1*a* each include a first connection terminal 6 and a second connection terminal 7. The short-circuit connection structures 1*a* are provided one at each end in the width direction X of the socket housing 5.

Socket Housing

The socket housing 5 is made of an insulating resin, and is formed in a rectangular parallelepiped shape as shown in FIGS. 1 to 5. The socket housing 5 has a leg portion 5A that is provided on the lower side, and a fitting portion 5B that is provided on the upper side.

Fixing metal fittings 5A1 are provided one at each end in the width direction X of the leg portion 5A. By soldering the fixing metal fittings 5A1 to the circuit board P1, the socket housing 5 is fixed to the circuit board P1.

The fitting portion 5B is substantially a rectangular parallelepiped, and has a front wall portion 5*a* and a back wall portion 5*b* that are along the X-Z plane, and side wall portions 5*c* that have plate surfaces along the Y-Z plane and connect the front wall portion 5*a* and the back wall portion 5*b*. The fitting portion 5B further has a fitting chamber 5*e* surrounded by the front wall portion 5*a*, the back wall portion 5*b*, and the side wall portions 5*c*. An insertion opening 5*f* into which the plug connector 3 is inserted is provided in the upper surface of the fitting portion 5B.

The front wall portion 5*a* and the back wall portion 5*b* are provided with terminal accommodating portions 5*d*, and the terminal accommodating portions 5*d* communicate with the fitting chamber 5*e*. The terminal accommodating portions 5*d* are disposed in each of the front wall portion 5*a* and the back wall portion 5*b* of the socket housing 5, in parallel along the width direction X. The socket terminals 2 are accommodated one in each of the terminal accommodating portions 5*d*. Because the terminal accommodating portions 5*d* provided in the front wall portion 5*a* and the terminal accommodating portions 5*d* provided in the back wall portion 5*b* are offset from each other in the width direction X, the socket terminals 2 housed in the respective terminal accommodating portions 5*d* are arranged in a staggered manner in plan view.

Each side wall portion 5*c* is provided, on its fitting chamber 5*e* side, with an accommodating portion 5*g* that accommodates a short-circuit contact piece 6*a* of the first connection terminal 6 and a switch piece 7*a* of the second connection terminal 7 to be described later. The accommodating portion 5*g* is a space that communicates with the fitting chamber 5*e*, and is disposed at a different position from the fitting chamber 5*e* in the width direction X. Therefore, the plug connector 3 can be prevented from coming into contact with the short-circuit contact piece 6*a* and the switch piece 7*a* accommodated in the accommodating portion 5*g*, and deformation or the like due to the contact of them can be suppressed. In addition, foreign matter can be prevented from coming into contact with the short-circuit connection part.

Socket Terminals

Figure 6:
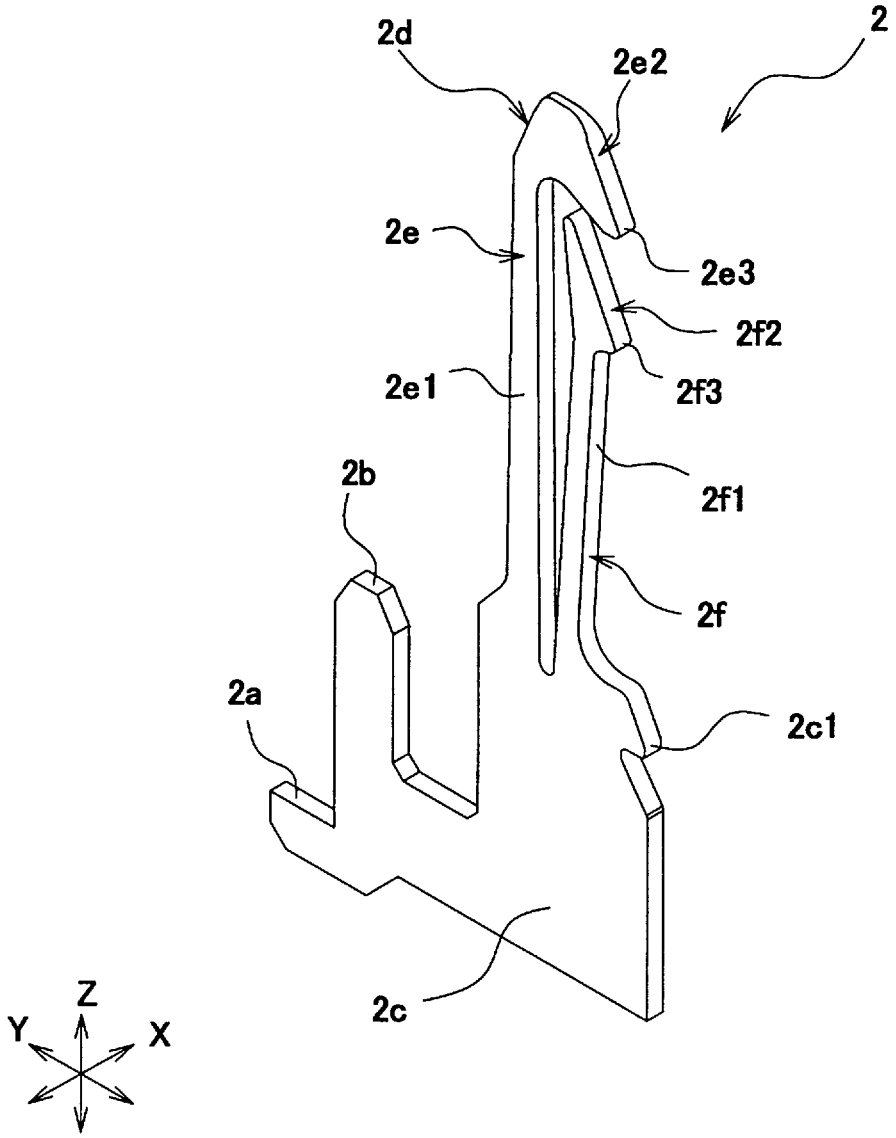
FIG. 6 is a perspective view showing the socket terminals of FIG. 1.

The socket terminals 2 are provided as stamped terminals made by stamping a metal plate as shown in FIG. 6, and are disposed such that the plate surfaces of the metal pieces are along the Y-Z plane. The socket terminals 2 are accommodated one in each of the terminal accommodating portions 5*d* of the socket housing 5, and are disposed in parallel along the width direction X between two short-circuit connection structures 1*a* to be described later. The socket terminals 2 each have a circuit board connection portion 2*a*, a housing fixing portion 2*b*, a proximal end portion 2*c*, and a terminal portion 2*d*.

The circuit board connection portion 2*a* has a plate edge along the X-Y plane, and is soldered to the circuit board P1.

The housing fixing portion 2*b* is provided so as to be continuous with the circuit board connection portion 2*a*, and is a flat plate having substantially rectangular plate surfaces. By press-fitting the housing fixing portion 2*b* into a fixing hole (not shown) of the socket housing 5, the socket terminal 2 is fixed to the socket housing 5.

The proximal end portion 2*c* is provided so as to be continuous with the housing fixing portion 2*b*. The proximal end portion 2*c* has an engaging portion 2*c*1 that is fixed to the socket housing 5. The engaging portion 2*c*1 bites into the inner wall (not shown) of the terminal accommodating portion 5*d* of the socket housing 5, and the socket terminal 2 is thereby fixed to the housing 5.

The terminal portion 2*d* extends upward from the upper end of the proximal end portion 2*c*, and has a front terminal 2*e* and a rear terminal 2*f*.

The front terminal 2*e* has a front elastic piece portion 2*e*1 and a front contact portion 2*e*2.

The front elastic piece portion 2*e*1 is an elongate elastic piece extending upward from the upper end of the proximal end portion 2*c*.

The front contact portion 2*e*2 is continuous with the upper end of the front elastic piece portion 2*e*1. The front contact portion 2*e*2 protrudes in a V-shape in a direction into contact with a plug contact portion 4*a* of the plug terminal 4 in a fitted state. This protruding part is provided with a front contact point portion 2*e*3 that comes into electrical contact with a terminal surface 4*a*1 of the plug contact portion 4*a*. During the fitting together of the socket connector 1 and the plug connector 3, the front contact point portion 2*e*3 comes into sliding contact with the terminal surface 4*a*1 of the plug contact portion 4*a*.

The rear terminal 2*f* has a rear elastic piece portion 2*f*1 and a rear contact portion 2*f*2.

The rear elastic piece portion 2*f*1 is an elongate elastic piece extending upward from the upper end of the proximal end portion 2*c*. The rear elastic piece portion 2*f*1 is provided adjacent to the front elastic piece portion 2*e*1, and is disposed nearer to the fitting chamber 5*e* than the front elastic piece portion 2*e*1.

The rear contact portion 2*f*2 is continuous with the upper end of the rear elastic piece portion 2*f*1. The rear contact portion 2*f*2 protrudes in a V-shape toward the plug contact portion 4*a* of the plug connector 3 in a fitted state. This protruding part is provided with a rear contact point portion 2*f*3 that comes into electrical contact with the terminal surface 4*a*1 of the plug contact portion 4*a*. Because the rear contact point portion 2*f*3 is disposed below the front contact point portion 2*e*3 in the fitting direction of the plug connector 3, during the fitting the plug terminal 4 first comes into sliding contact with the front contact point portion 2*e*3 and then comes into sliding contact with the rear contact point portion 2*f*3. The rear contact point portion 2*f*3 and the plug contact portion 4*a* are disposed along the fitting direction of the plug connector 3, and are disposed at the same position in the width direction X. Therefore, during the fitting of the plug connector 3, the rear contact point portion 2*f*3 follows the front contact point portion 2*e*3, and comes into sliding contact with a sliding locus on the terminal surface 4*a*1 of the plug contact portion 4*a*.

First Connection Terminal

Figure 7:
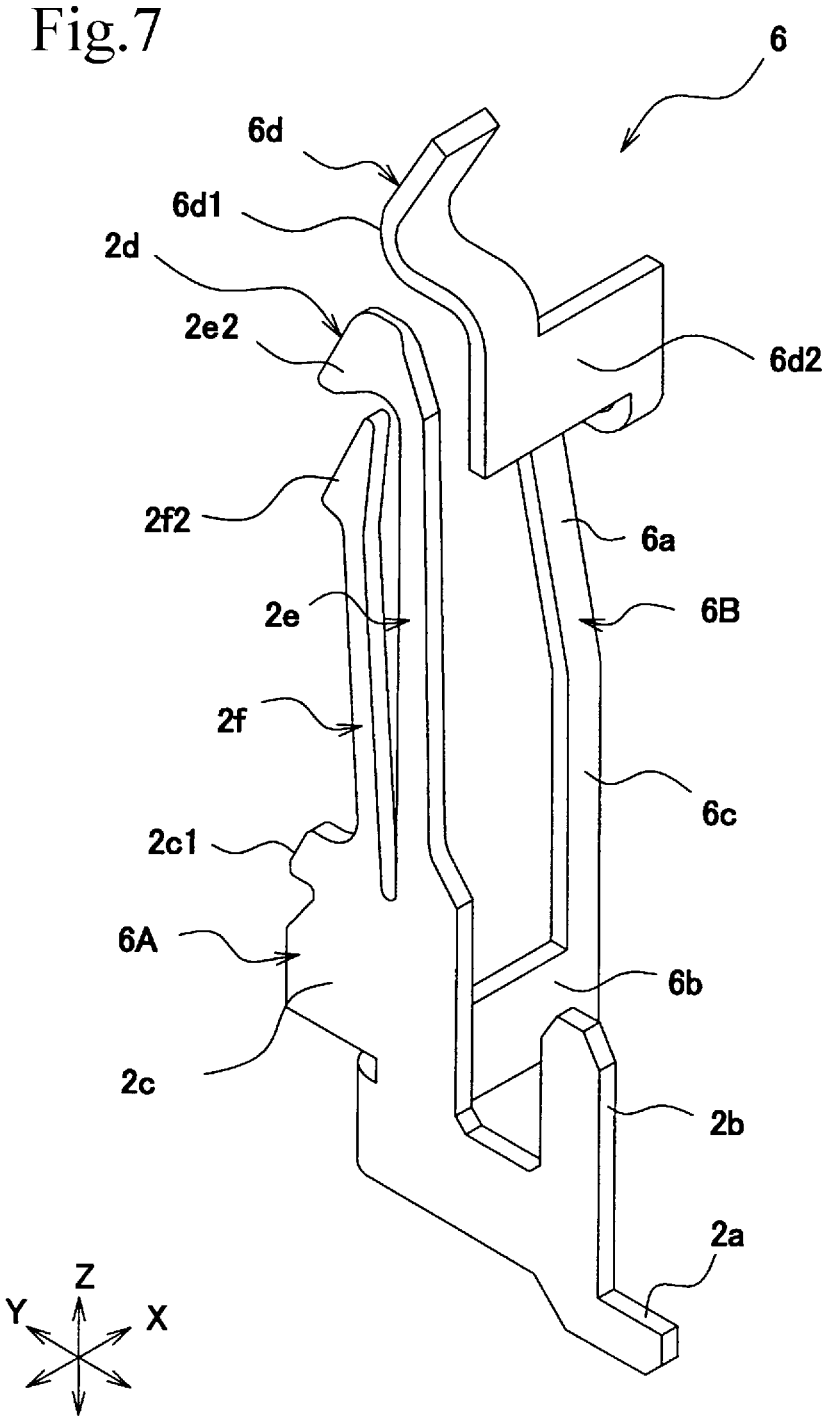
FIG. 7 is a back perspective view showing the first connection terminal of FIG. 1.
Figure 8:
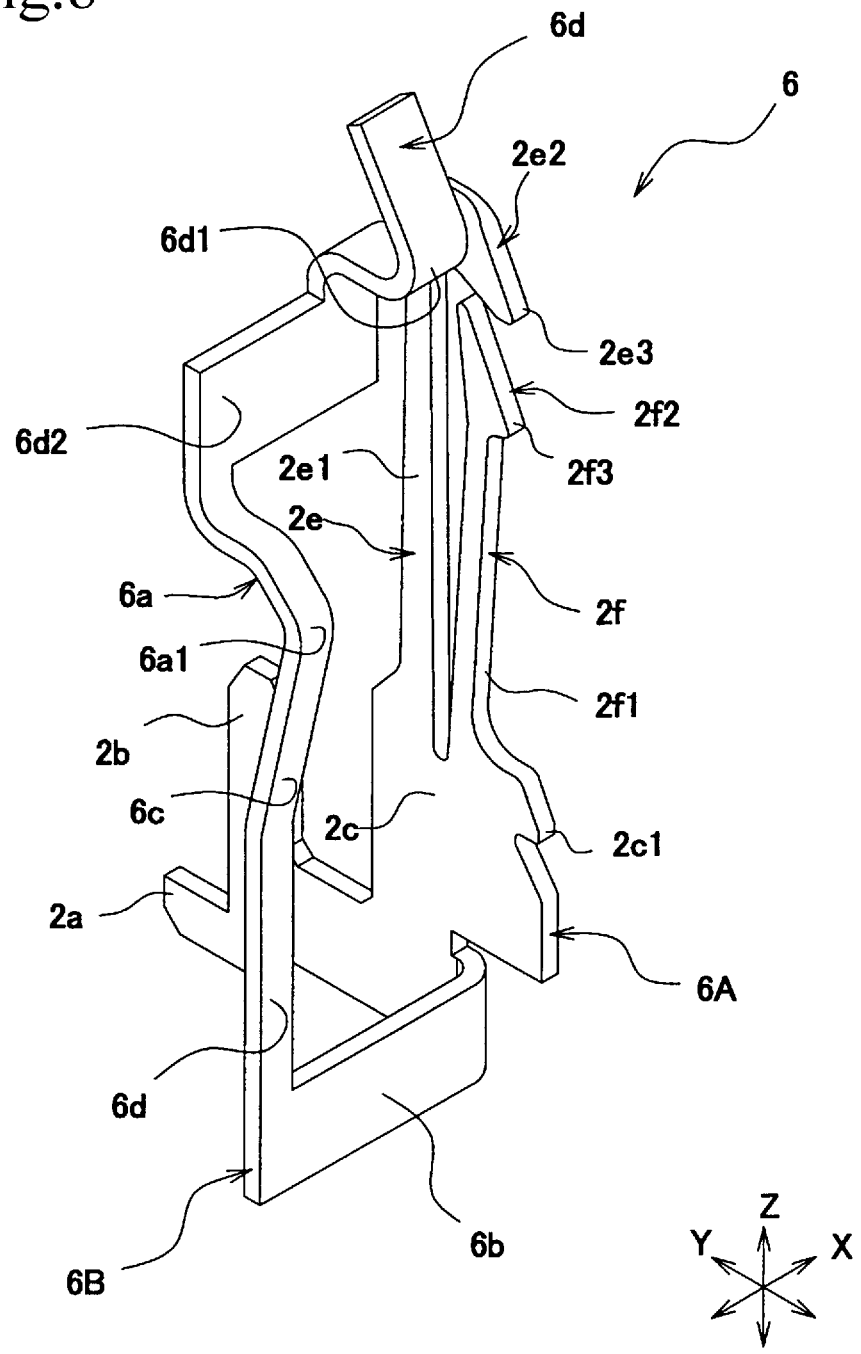
FIG. 8 is a front perspective view showing the first connection terminal of FIG. 7.
Figure 9:
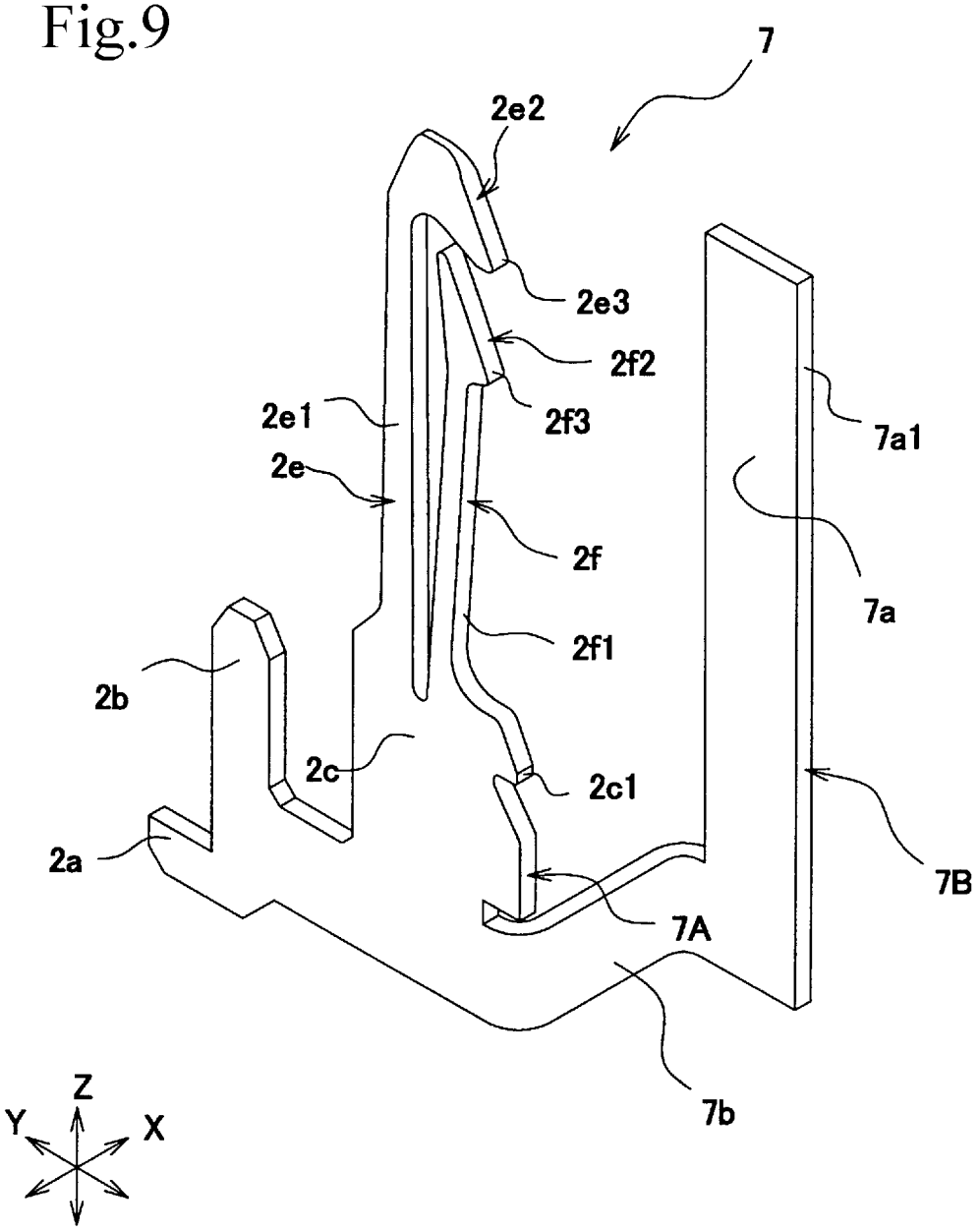
FIG. 9 is a perspective view showing the second connection terminal of FIG. 1.

As shown in FIGS. 7 and 8, the first connection terminals 6 are provided one at each of one end in the width direction X of the front wall portion 5*a* of the socket housing 5 and the other end in the width direction X of the back wall portion 5*b*. The first connection terminals 6 each have a terminal body 6A and a switch contact piece 6B. As with the socket terminals 2, the terminal body 6A has a circuit board connection portion 2*a*, a housing fixing portion 2*b*, a proximal end portion 2*c*, and a terminal portion 2*d*.

The switch contact piece 6B has a connecting portion 6*b*, an elastic arm 6*c*, a short-circuit contact piece 6*a*, and an opening contact piece 6*d*.

The connecting portion 6*b* is an elongate piece portion extending along the width direction X from the proximal end portion 2*c*. Owing to such a connecting portion 6*b*, a short-circuit contact piece 6*a* to be described later can be disposed at a different position from the terminal body 6A in the width direction X. In addition, the short-circuit contact piece 6*a* can be accommodated in the accommodating portion 5*g* provided in the side wall portion 5*c* of the socket housing 5, with the terminal portion 2*d* of the terminal body 6A protruding into the fitting chamber 5*e*. The elastic arm 6*c* extends upward from the connecting portion 6*b*, and elastically supports the short-circuit contact piece 6*a* and the opening contact piece 6*d* provided at its distal end.

The short-circuit contact piece 6*a* is a V-shaped elastic piece that protrudes toward the switch piece 7*a* of the second connection terminal 7 disposed opposite thereto. The short-circuit contact piece 6*a* has, at its apex, a short-circuit contact point portion 6*a*1 that comes into electrical contact with the switch piece 7*a*. The short-circuit contact piece 6*a* is accommodated in the accommodating portion 5*g* provided in the side wall portion 5*c* of the socket housing 5, and does not protrude into the fitting chamber 5*e*.

Figure 13:
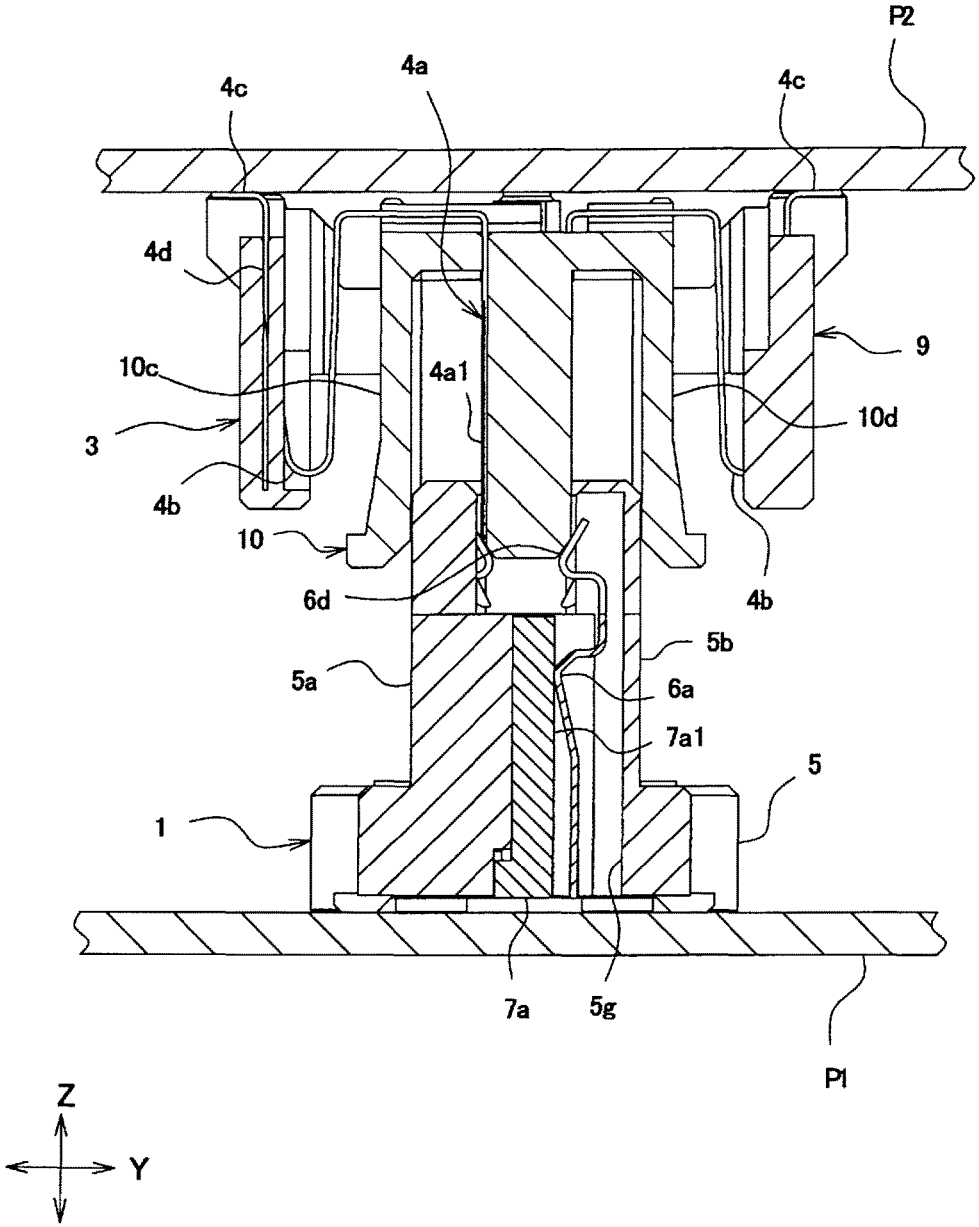
FIG. 13 is a sectional view taken along line XIII-XIII of FIG. 12.
Figure 14:
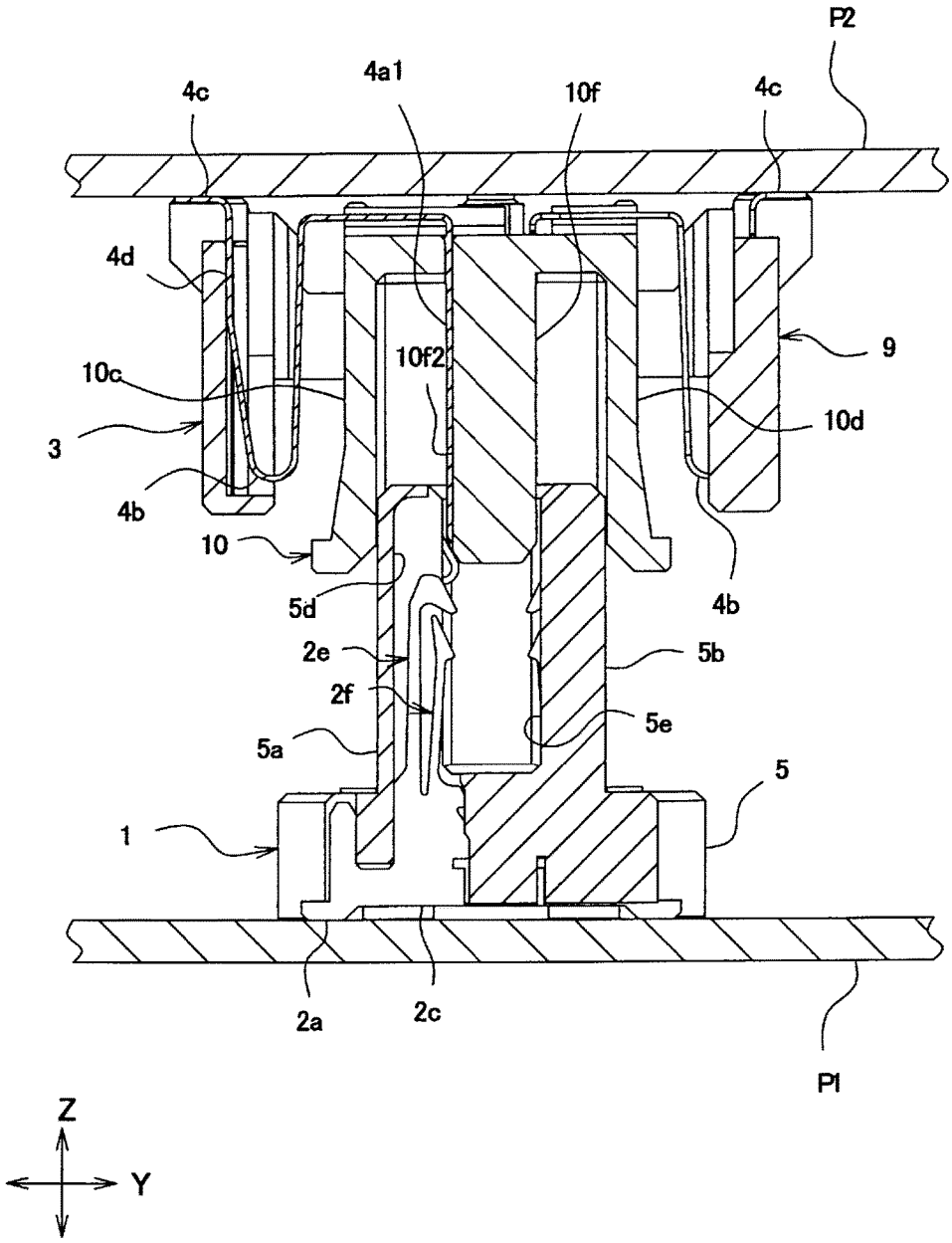
FIG. 14 is a sectional view taken along line XIV-XIV of FIG. 12.

The opening contact piece 6*d* is disposed above the short-circuit contact piece 6*a*. The opening contact piece 6*d* has an opening contact point portion 6*d*1 having a V-shape, and a connecting piece 6*d*2 that connects the short-circuit contact piece 6*a* and the opening contact point portion 6*d*1. The connecting piece 6*d*2 extends along the width direction X, and the opening contact piece 6*d* can thereby be protruded from the accommodating portion 5*g* of the side wall portion 5*c* into the fitting chamber 5*e*. The height position of the opening contact point portion 6*d*1 (H1 of FIG. 10) is disposed above the height position of the terminal portions 2*d* of the socket terminal 2, the first connection terminal 6, and the second connection terminal 7 (H2 of FIG. 10) in the height direction Z. By doing so, during the fitting of the plug connector 3, a pressing portion 10*f*1 of a plug housing 8 comes into pressure contact with the opening contact piece 6*d* before the plug terminals 4 of the plug connector 3 come into contact with the terminal portions 2*d* (FIGS. 13 and 14). The short-circuit contact piece 6*a* and the opening contact piece 6*d* are supported by the same elastic arm 6*c* at its distal end. Therefore, by elastically deforming the elastic arm 6*c*, the short-circuit contact piece 6*a* and the opening contact piece 6*d* can be elastically displaced in conjunction with each other.

Since the terminal body 6A and the switch contact piece 6B are connected with the connecting portion 6*b* on the side of the circuit board P1, the terminal body 6A and the switch contact piece 6B can be deformed independently from each other. Therefore, if the terminal body 6A is repeatedly elastically deformed owing to the insertion and extraction of the plug connector 3, a situation where the switch contact piece 6B is influenced by it and becomes difficult to bring into electrical contact with a switch portion 7B is less likely to arise. In addition, if the switch contact piece 6B is repeatedly elastically deformed owing to the insertion and extraction of the plug connector 3, a situation where the terminal body 6A is influenced by it and becomes difficult to bring into electrical contact with the connection object is less likely to arise. Since the first connection terminal 6 includes the terminal body 6A that comes into electrical contact with the plug contact portion 4*a*, and the switch contact piece 6B, the number of parts can be reduced compared to a case where the terminal body 6A and the switch contact piece 6B are provided as separate members.

Second Connection Terminal

Figure 10:
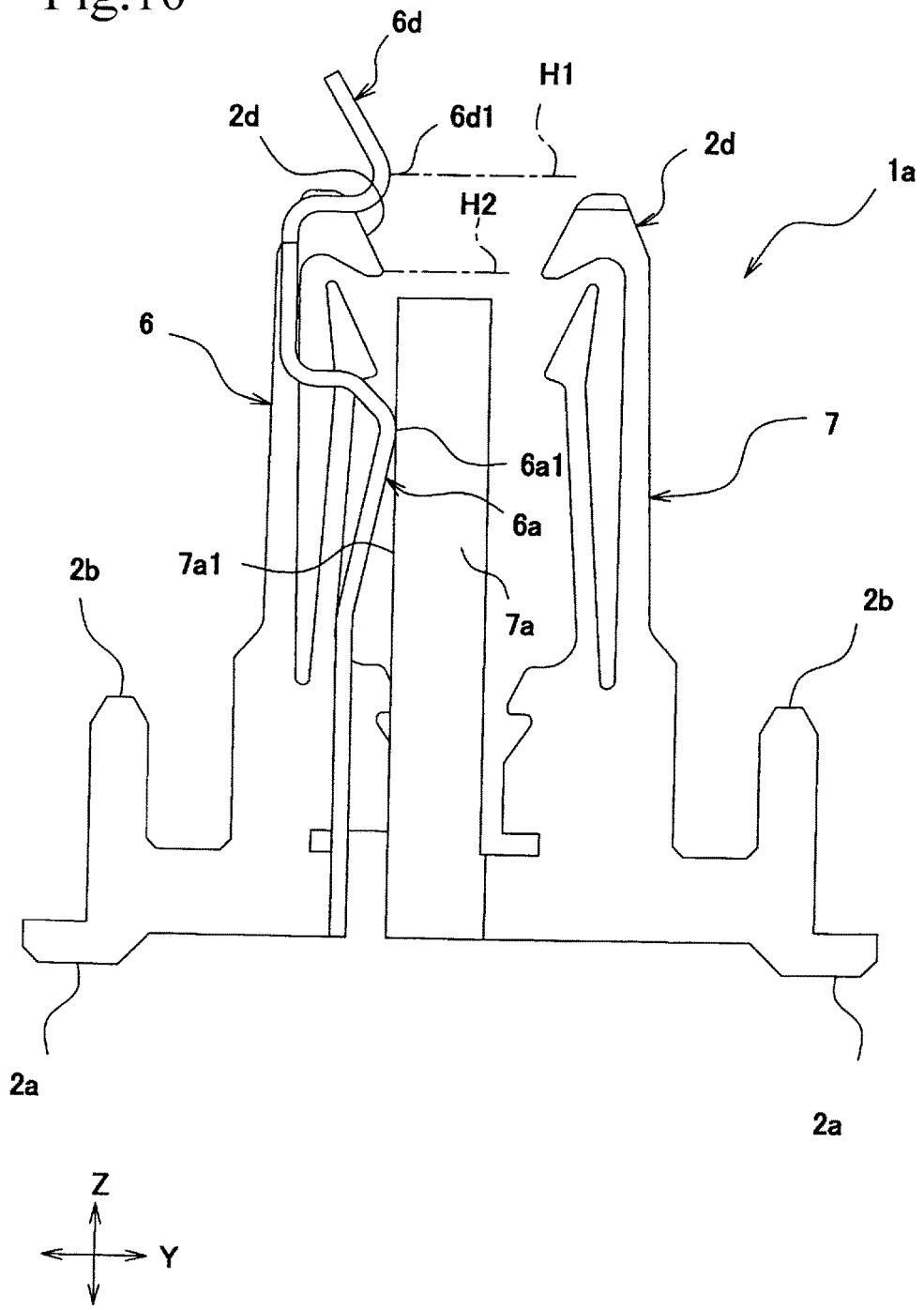
FIG. 10 illustrates a short-circuit connection structure including the first connection terminal of FIG. 7 and the second connection terminal of FIG. 9.

As shown in FIG. 10, the second connection terminal 7 forms a short-circuit connection structure 1*a* together with the first connection terminal 6. The second connection terminals 7 are provided one at each of one end in the width direction X of the front wall portion 5*a* and the other end in the width direction X of the back wall portion 5*b*. The second connection terminals 7 each have a terminal body 7A and a switch portion 7B. The terminal body 7A has a circuit board connection portion 2*a*, a housing fixing portion 2*b*, a proximal end portion 2*c*, and a terminal portion 2*d* that have the same structure as the socket terminal 2.

The switch portion 7B has a connecting portion 7*b* and a switch piece 7*a*. The connecting portion 7*b* is an elongate piece portion extending along the width direction X from the proximal end portion 2*c*. The switch piece 7*a* is provided so as to be continuous with the connecting portion 7*b*, and is a plate-like piece along the Y-Z plane. Owing to the connecting portion 7*b*, the switch piece 7*a* is disposed at a different position from the terminal body 7A in the width direction X. In addition, the switch piece 7*a* can be accommodated in the accommodating portion 5*g* provided in the side wall portion 5*c* of the socket housing 5, with the terminal body 7A disposed in the fitting chamber 5*e*. In this embodiment, a plate edge portion 7*a*1 of the switch piece 7*a* comes into electrical contact with the short-circuit contact point portion 6*a*1 of the first connection terminal 6.

Since the terminal body 7A and the switch piece 7*a* are connected with the connecting portion 7*b* on the side of the circuit board P1, the terminal body 7A can be elastically deformed independently from the switch portion 7B. Therefore, if the terminal body 7A is repeatedly elastically deformed owing to the insertion and extraction of the plug connector 3, a situation where the switch piece 7*a* thereby becomes difficult to bring into electrical contact with the switch contact piece 6B is less likely to arise. Since the second connection terminal 7 including the terminal body 7A that comes into electrical contact with the plug contact portion 4*a*, and the switch piece 7*a* is provided, the number of parts can be reduced compared to a case where the terminal body 7A and the switch piece 7*a* are provided as separate members.

Plug Connector

The plug connector 3 is a floating connector including a plug housing 8 and plug terminals 4.

Plug Housing

Figure 11:
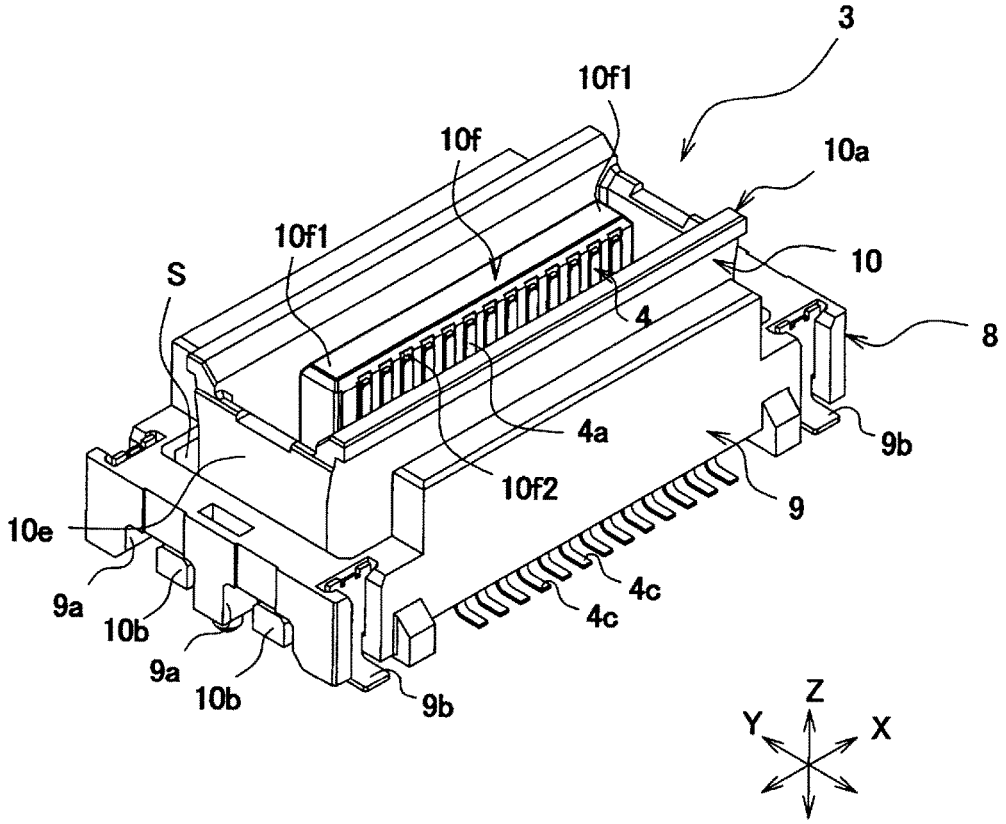
FIG. 11 is a perspective view of a plug connector that is a fitting counterpart of the socket connector of FIG. 1.
Figure 12:
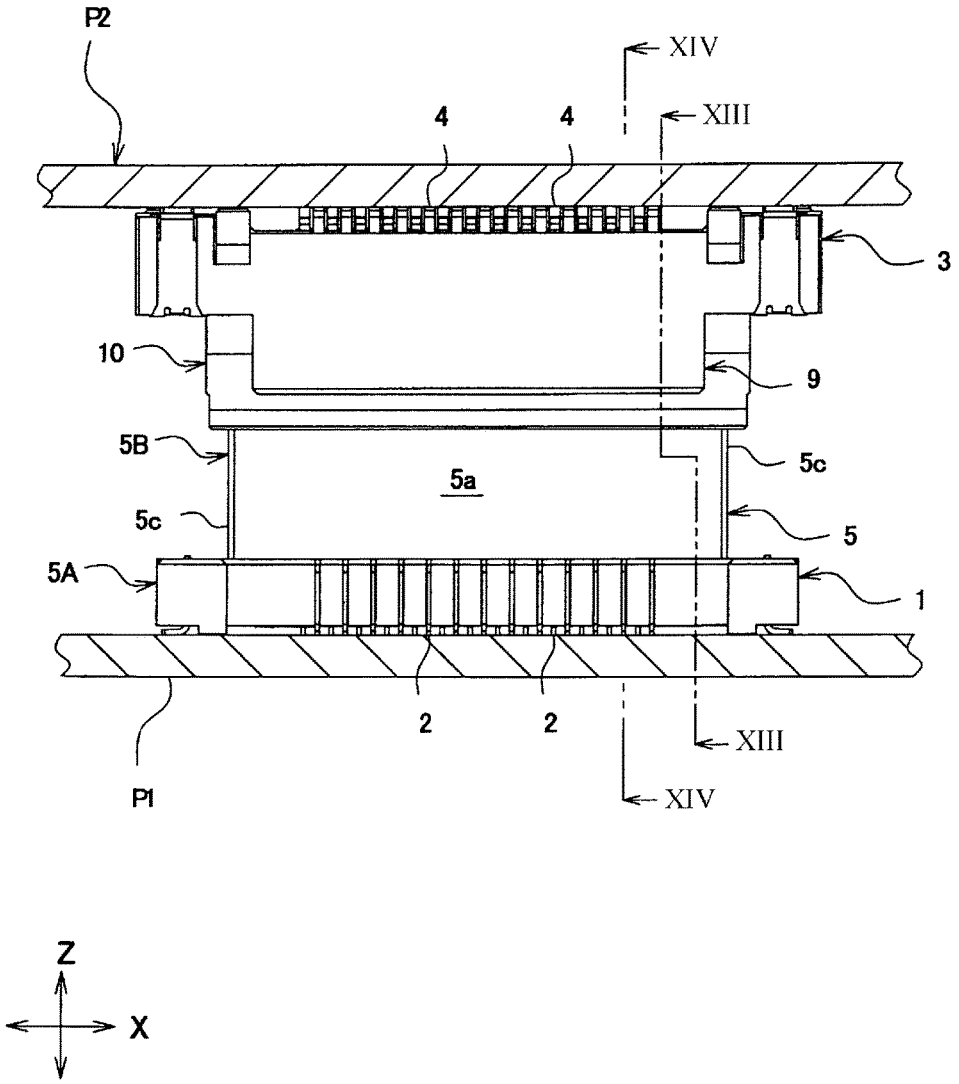
FIG. 12 is a front view showing an unfitted state of the socket connector of FIG. 1 and the plug connector of FIG. 11.

As shown in FIGS. 11 and 12, the plug housing 8 includes a stationary housing 9 and a movable housing 10.

Stationary Housing

The stationary housing 9 is made of an insulating resin, and has a frame shape that surrounds the outer peripheral surface of the movable housing 10. A movable space S in which the movable housing 10 is movable is formed between the stationary housing 9 and the movable housing 10. Housing fixing portions 4*d* of the plug terminals 4 to be described later are fixed to the stationary housing 9. The stationary housing 9 is provided with engaging recessed portions 9*a* with which the movable housing 10 is engaged, and fixing metal fittings 9*b* that are soldered to the circuit board P2.

Movable Housing

The movable housing 10 is made of an insulating resin, and is held displaceably relative to the stationary housing 9. The movable housing 10 can be displaced in the movable space S of the stationary housing 9, relative to the stationary housing 9. The movable housing 10 has a housing body 10*a* that is fitted into the socket connector 1.

The housing body 10*a* has a front wall portion 10*c*, a back wall portion 10*d*, side wall portions 10*e*, and a fitting wall 10*f*.

The front wall portion 10*c* and the back wall portion 10*d* have plate surfaces along the X-Z plane. The front wall portion 10*c* has accommodating portions (not shown) that accommodate the plug terminals 4. The side wall portions 10*e* connect the front wall portion 10*c* and the back wall portion 10*d*, and have plate surfaces along the Y-Z plane.

The side wall portions 10*e* have engaging portions 10*b* that engage with the stationary housing 9. The engaging portions 10*b* are provided, two on each of the side wall portions 10*e*, along the front-back direction Y, and are accommodated in the engaging recessed portions 9*a* of the stationary housing 9.

The fitting wall 10*f* is provided between the front wall portion 10*c* and the back wall portion 10*d*, and has plate surfaces along the X-Z plane. Pressing portions 10*f*1 that press the opening contact point portions 6*d*1 of the first connection terminals 6 of the socket connector 1 are provided on the top surface of the fitting wall 10*f* and at both ends in the width direction X. Terminal grooves 10*f*2 to which the plug contact portions 4*a* of the plug terminals 4 are fixed are provided in a plate surface of the fitting wall 10*f* that faces the front wall portion 10*c* and a plate surface of the fitting wall 10*f* that faces the back wall portion 10*d*.

Plug Terminals

Figure 16:
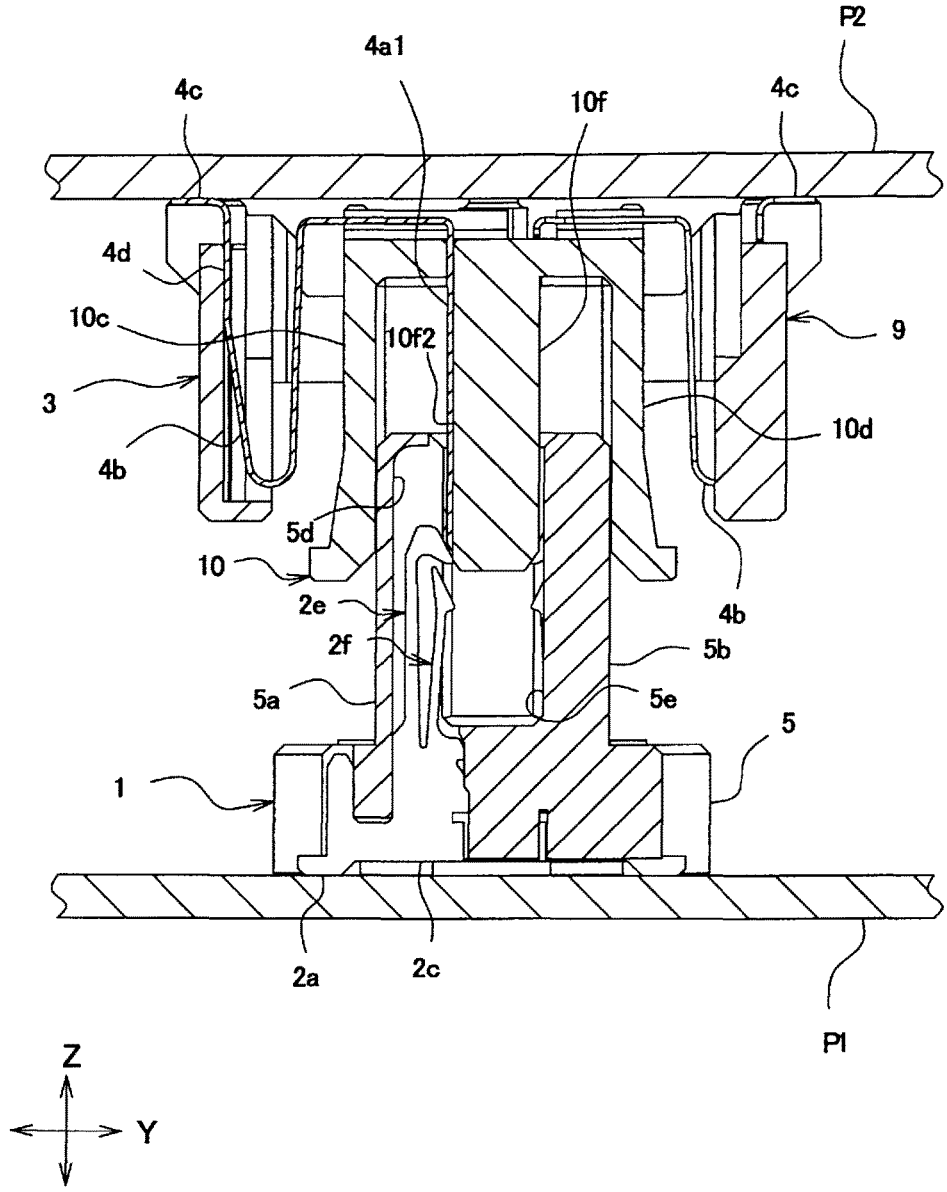
FIG. 16 is a sectional view corresponding to FIG. 14, showing the state of FIG. 15.
Figure 18:
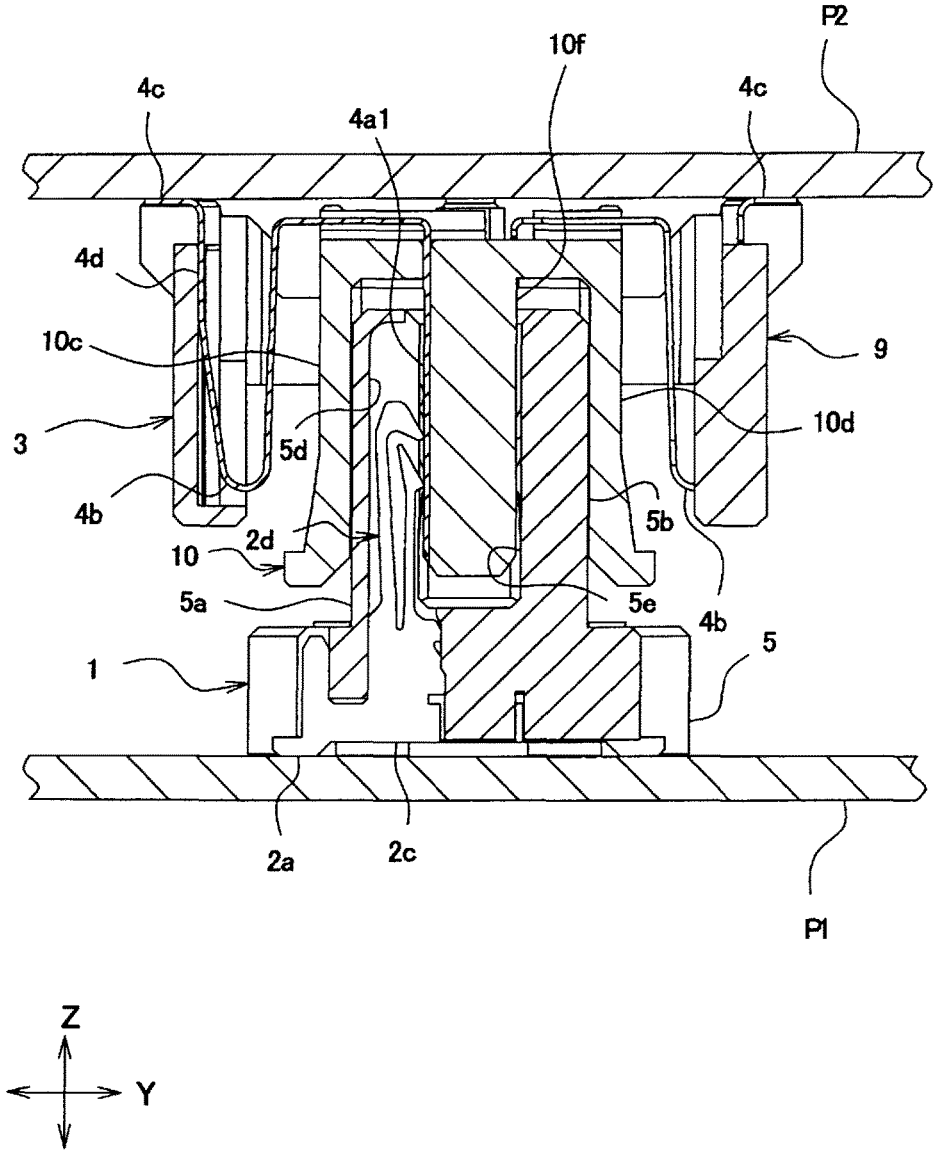
FIG. 18 is a sectional view corresponding to FIG. 14, showing the state of FIG. 17.

The plug terminals 4 are formed by bending metal pieces formed by stamping a metal plate. As shown in FIGS. 14, 16, and 18, the plug terminals 4 each have a circuit board connection portion 4*c*, a housing fixing portion 4*d*, a movable portion 4*b*, and a plug contact portion 4*a*.

The circuit board connection portion 4*c* has a flat, substantially rectangular plate surface. The circuit board connection portion 4*c* is soldered to the circuit board P2, with this substantially rectangular plate surface in contact with the circuit board surface of the circuit board P2.

The housing fixing portion 4*d* is fixed to the inside of a holding groove (not shown) provided in the stationary housing 9.

The movable portion 4*b* is provided as an elongate metal piece that extends from the housing fixing portion 4*d*. The movable portion 4*b* has a substantially U-shape, is continuous at one end with the circuit board connection portion 4*c*, and is continuous at the other end with the plug contact portion 4*a* to be described later. When vibration, shock, or the like is applied to the plug connector 3, the movable portion 4*b* is elastically displaced in the width direction X or the front-back direction Y, and the movable housing 10 can thereby be displaced relative to the stationary housing 9.

The plug contact portion 4*a* has a plate surface along the X-Z plane. The plug contact portion 4*a* has engaging protrusions (not shown) at both ends in the width direction X, and is press-fitted and fixed to one of terminal grooves 10*f*2 provided in both the front side and back side surfaces of the fitting wall 10*f*.

How to Open Closed Circuit

Figure 15:
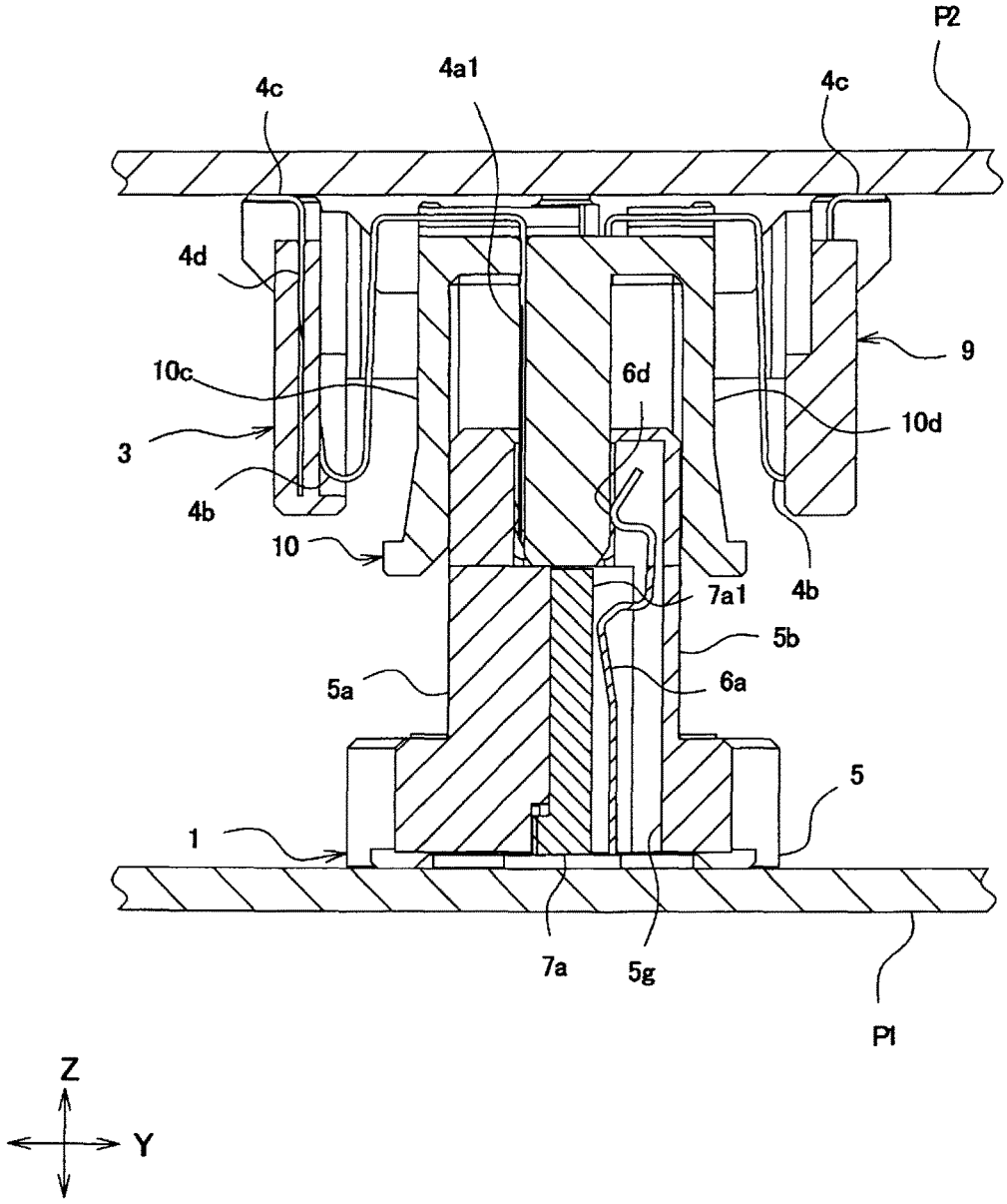
FIG. 15 is a sectional view showing a state where the fitting together of the socket connector and the plug connector is continued further from the state of FIG. 13.
Figure 17:
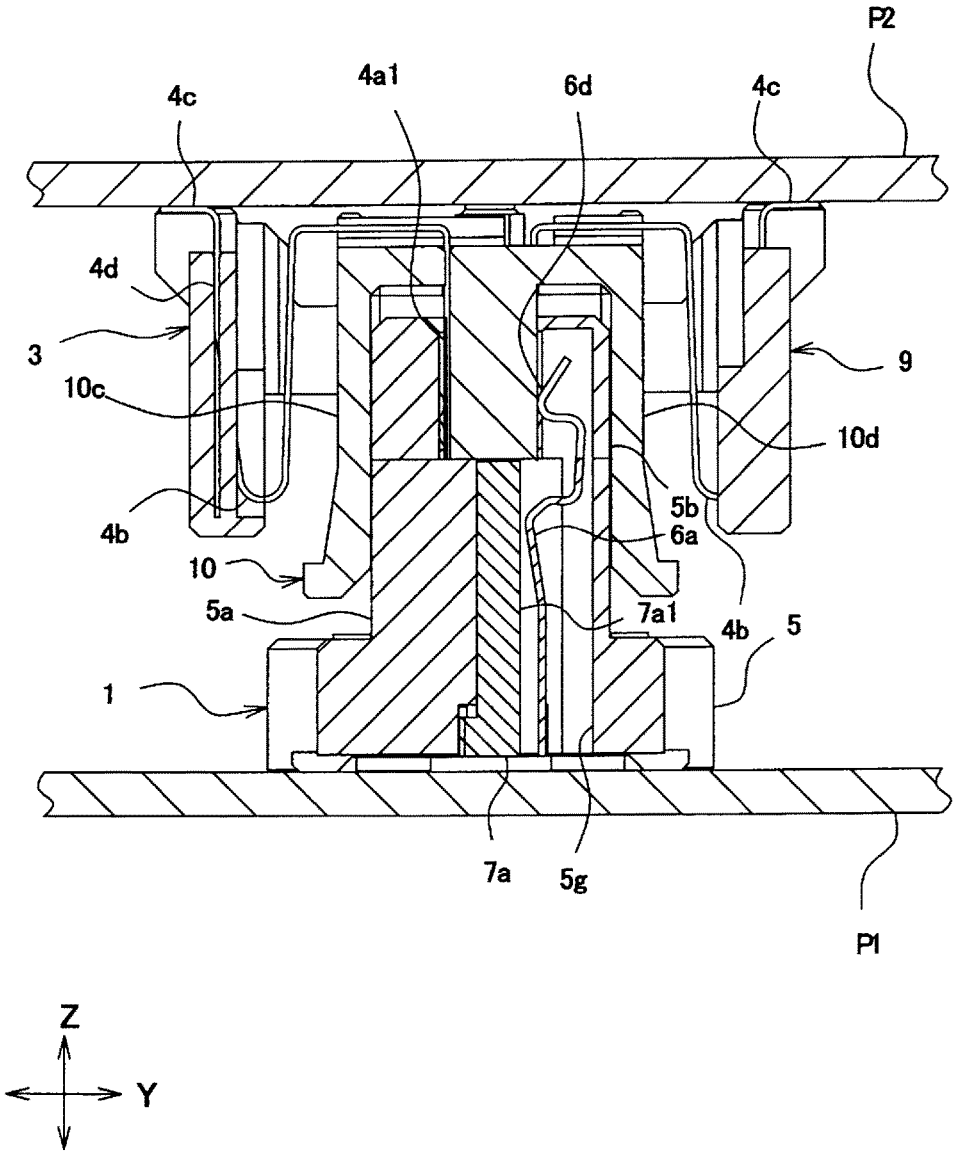
FIG. 17 is a sectional view showing a state in which the fitting of the plug connector into the socket connector has been completed.

How to use the socket connector 1 of this embodiment will be described. FIGS. 13 and 14, FIGS. 15 and 16, and FIGS. 17 and 18 are sectional views each showing the same stage in the process of fitting together of the socket connector 1 and the plug connector 3. That is, FIGS. 13 and 14 show an unfitted state, FIGS. 15 and 16 show a half-fitted state, and FIGS. 17 and 18 show a fitted state.

The socket connector 1 is fixed to the circuit board P1, and the plug connector 3 is fixed to the circuit board P2. As shown in FIGS. 10, 13, and 14, in a state where the plug connector 3 is not fitted, the short-circuit contact point portion 6*a*1 of the first connection terminal 6 provided in the socket connector 1 is in electrical contact with the plate edge portion 7*a*1 of the switch piece 7*a* of the second connection terminal 7. Therefore, in this unfitted state, a closed circuit in which the circuit board P1, the first connection terminal 6, and the second connection terminal 7 are short-circuited is formed.

In that state, the plug connector 3 is inserted through the insertion opening 5*f* provided in the socket connector 1, into the inside of the fitting chamber 5*e*. As shown in FIGS. 15 and 16, during the fitting of the plug connector 3, the pressing portion 10*f*1 of the plug housing 8 presses the opening contact point portion 6*d*1 of the first connection terminal 6 provided in the socket connector 1, in the inside of the fitting chamber 5*e*. The elastic arm 6*c* is elastically deformed, and the opening contact piece 6*d* are thereby elastically displaced away from the plug contact portion 4*a*. Thereby, the short-circuit contact point portion 6*a*1 disposed between the opening contact point portion 6*d*1 and the elastic arm 6*c* is also elastically displaced away from the plug connector 3 in the front-back direction Y. The switch contact piece 6B has the short-circuit contact piece 6*a* at its proximal end, and the opening contact piece 6*d* at its distal end. Therefore, if the opening contact point portion 6*d*1 at the distal end is pressed with a smaller force, the elastic arm 6*c* can be easily elastically deformed by using the principle of leverage. Thus, the short-circuit contact point portion 6*a*1 comes out of contact with the plate edge portion 7*a*1 of the switch piece 7*a* of the second connection terminal 7. Thereby, the closed circuit formed by the circuit board P1, the first connection terminal 6, and the second connection terminal 7 can be opened. In this state, the opening contact piece 6*d* is pressed by the fitting wall 10*f* of the plug housing 8, the elastic arm 6*c* is thereby elastically deformed, and restoring force toward the fitting wall 10*f* acts.

Thereafter, the fitting together of the socket connector 1 and the plug connector 3 is further continued. The opening contact piece 6*d* is disposed above the terminal portion 2*d* of the socket terminal 2 in the height direction Z. Therefore, after the pressing portion 10*f*1 of the plug housing 8 comes into contact with the opening contact piece 6*d* and the above closed circuit is reliably opened, the plug contact portion 4*a* of the plug terminal 4 comes into electrical contact with the terminal portion 2*d* of the socket terminal 2. Since the opening contact piece 6*d* is thus disposed, the electrical continuity between the circuit board P1 and the circuit board P2 can be established after the above closed circuit is reliably disconnected. Therefore, the formation of an unintended circuit, such as that in which the electrical continuity between the circuit boards P1 and P2 is established although the closed circuit is not opened, can be prevented.

Since the front contact portion 2*e*2 of the front terminal 2*e* is disposed above the rear contact portion 2*f*2 of the rear terminal 2*f* in the height direction Z, the front contact portion 2*e*2 comes into electrical contact with the plug contact portion 4*a* first, and then the rear contact portion 2*f*2 comes into electrical contact with the plug contact portion 4*a* (FIGS. 16 and 18). Thus, the fitting together of the socket connector 1 and the plug connector 3 is completed. A new circuit is thereby formed by the circuit board P1, the socket terminal 2, the plug terminal 4, and the circuit board P2.

In this embodiment, as described above, the socket terminals 2 each have a front contact point portion 2*e*3 and a rear contact point portion 2*f*3, and a foreign matter removing function is thereby provided. Specifically, during the fitting, the front contact point portion 2*e*3 comes into sliding contact with the terminal surface 4*a*1 of the plug contact portion 4*a*, and then the rear contact point portion 2*f*3 comes into electrical contact with a sliding locus thereof. Therefore, the front contact point portion 2*e*3 wipes the terminal surface 4*a*1 of the plug contact portion 4*a* to remove foreign matter, so that the rear contact point portion 2*f*3 can come into electrical contact with the sliding locus of the front contact point portion 2*e*3 from which foreign matter is removed. Therefore, the rear contact point portion 2*f*3 can reliably come into electrical contact with the plug contact portion 4*a*, and therefore the socket terminal 2 has higher connection reliability.

How to Re-Form Closed Circuit

When the plug connector 3 is extracted from the fitting chamber 5*e* of the socket connector 1, first, the plug terminals 4 come out of contact with the socket terminals 2, and the circuit that electrically connects the circuit board P1 and the circuit board P2 is thereby opened. Thereafter, the extracting operation is further continued, and the pressing portions 10*f*1 of the plug connector 3 thereby come out of contact with the opening contact portions 6*d*1 of the first connection terminals 6 of the socket connector 1. Thereby, the above restoring force elastically deforms the elastic arms 6*c* toward the switch pieces 7*a* of the second connection terminals 7 in the front-back direction Y. Accordingly, the short-circuit contact pieces 6*a* are also elastically deformed likewise, and come into electrical contact with the plate edge portions 7*a*1 of the switch pieces 7*a* of the second connection terminals 7. Thus, a closed circuit between the circuit board P1, the first connection terminal 6, and the second connection terminal 7 is re-formed.

Thus, by inserting and extracting the plug connector 3 into and from the socket connector 1, the short-circuit contact pieces 6*a* of the first connection terminals 6 can be displaced toward and away from the second connection terminals 7 to form the above closed circuit, and to open the closed circuit and establish a circuit between the circuit board P1 and the circuit board P2. Therefore, it is possible to usually use only the above closed circuit, and to fit the plug connector 3 fixed to the circuit board P2 into the socket connector 1 only when the function of a product is desired to be expanded. When that function is no longer required, the plug connector 3 can be extracted from the socket connector 1 to establish the original closed circuit.

Since, as described above, the socket connector 1 of this embodiment is provided with the first connection terminal 6 and the second connection terminal 7, in the fitted state, signal connection can be reliably performed by ensuring the electrical connection between the socket terminals 2 and the plug terminals 4 and opening the short-circuit connection, and in the unfitted state, the short-circuit connection can be reliably performed. In addition, since the first connection terminal 6 has the terminal body 6A and the switch contact piece 6B that elastically displaced independently from each other, the formation and opening of the closed circuit can be performed even after the plug connector 3 is repeatedly inserted and extracted.

Modifications of Embodiment

The socket terminals 2 of the above-described embodiment each have a plurality of contact point portions: a front contact point portion 2*e*3 and a rear contact point portion 2*f*3. The front contact point portion 2*e*3 wipes the terminal surface 4*a*1 of the plug contact portion 4*a* to remove foreign matter, and the rear contact point portion 2*f*3 comes into electrical contact with that part. Alternatively, the socket terminals 2 may each have only one contact point portion. By doing so, the cost of material can be reduced.

In the above-described embodiment, the opening contact point portion 6*d*1 is disposed above the terminal portions 2*d* of the socket terminals 2 in the height direction Z and close to the insertion opening 5*f* for the socket housing 5. Therefore, the electrical contact between the first connection terminal 6 and the second connection terminal 7 is reliably disconnected to open the closed circuit, and then the terminal portion 2*d* of the socket terminal 2 is brought into electrical contact with the plug contact portion 4*a*. Alternatively, the opening contact point portion 6*d*1 may be disposed below the terminal portions 2*d* of the socket terminals 2 in the height direction Z and at a position distant from the insertion opening 5*f*. In this case, the pressing portions 10*f*1 of the plug housing 8 may be extended below the terminal portion 2*d* of the socket terminals 2 in the height direction Z so that the pressing portions 10*f*1 press the opening contact piece 6*d* before the terminal portion 2*d* of the socket terminals 2 come into electrical contact with the plug contact portion 4*a*.

What is claimed is:

1. An electric connector comprising:

a first connection terminal and a second connection terminal that come into electrical contact with a connection object; and a housing having an insertion opening for the connection object, wherein the first connection terminal has a switch contact piece having an opening contact point portion that comes into pressure contact with the connection object inserted into the housing, a short-circuit contact piece having a short-circuit contact point portion that comes into electrical contact with the second connection terminal, and an elastic arm that elastically supports the opening contact point portion and the short-circuit contact piece and that is elastically deformed when the opening contact point portion is pressed by the connection object, and thereby brings the short-circuit contact point portion out of contact with the second connection terminal, and a terminal body having a terminal portion that comes into electrical contact with the connection object, wherein the opening contact point portion is disposed at a fitting chamber of the housing that disposes the terminal portion, the opening contact point portion and the terminal portion coming into contact with the connection object inside the fitting chamber, the short-circuit contact piece and the elastic arm are disposed at an accommodating portion inside a side wall portion of the housing that forms the fitting chamber, and the short-circuit contact point portion comes into contact with the second connection terminal inside the accommodating portion, wherein the switch contact piece includes a connecting piece that connects the opening contact point portion that is disposed at the fitting chamber and the short-circuit contact piece that is disposed at the accommodating portion and a connecting portion that connects the terminal body disposed at the fitting chamber and the elastic arm disposed at the accommodating portion, and wherein the opening contact point portion disposed at the fitting chamber and the short-circuit contact point portion disposed at the accommodating portion are disposed at different positions spaced apart in a direction that is perpendicular with respect to an insertion and extraction direction of the connection object.

2. The electric connector according to claim 1, wherein the terminal portion includes a contact point portion with the connection object, and wherein the opening contact point portion is disposed nearer to the insertion opening than the contact point portion in the insertion and extraction direction of the connection object.

3. The electric connector according to claim 1, wherein the switch contact piece has the opening contact point portion on the distal end side of the short-circuit contact point portion, and has the elastic arm on the proximal end side of the short-circuit contact point portion.

4. The electric connector according to claim 1, wherein the second connection terminal includes a switch portion having a switch piece that comes contact with the short-circuit contact point portion and another terminal body having another terminal portion that comes into electrical contact with the connection object.

* * * * *